US010234109B1

(12) United States Patent
Jacobs

(10) Patent No.: US 10,234,109 B1
(45) Date of Patent: Mar. 19, 2019

(54) SINGLE-PIECE END CAP

(71) Applicant: Cooper Technologies Company, Houston, TX (US)

(72) Inventor: Rodney Colin Jacobs, Vienna, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/660,662

(22) Filed: Jul. 26, 2017

Related U.S. Application Data

(60) Provisional application No. 62/367,451, filed on Jul. 27, 2016.

(51) Int. Cl.
*F21V 17/12* (2006.01)
*F21V 15/015* (2006.01)

(52) U.S. Cl.
CPC ..... *F21V 15/015* (2013.01); *F21V 17/12* (2013.01)

(58) Field of Classification Search
CPC ..... F21V 15/015
USPC ..... 362/217.12
See application file for complete search history.

(56) References Cited

U.S. PATENT DOCUMENTS 4,268,894 A * 5/1981 Bartunek ..... F21L 2/00 362/158
5,642,934 A * 7/1997 Haddad ..... F21V 15/01 362/147
6,530,674 B2 * 3/2003 Grierson ..... F21V 21/005 362/219
6,568,830 B2 * 5/2003 Yaphe ..... F21S 8/06 362/147
6,984,055 B2 * 1/2006 McCarthy ..... F21S 2/00 362/219
7,331,687 B1 * 2/2008 Noh ..... F21S 2/00 362/217.05
2011/0211330 A1 * 9/2011 Wang ..... H05B 33/0803 362/20
2017/0191640 A1 * 7/2017 Ji ..... F21V 29/89

OTHER PUBLICATIONS

Utilitech Pro White Integrated Led Remodel Recessed Light Kit; Loew's website; Oct. 2, 2016.
3" Recessed Light Kit with Swivel Trim and 50 Watt Bulbs, Remodeler's Non-IC Cans, Contractor Pack of 2 Lights; Altair Lighting, Amazon Dec. 19, 2014.

* cited by examiner

*Primary Examiner* — Seung H Lee
(74) *Attorney, Agent, or Firm* — King & Spalding LLP

(57) ABSTRACT

A single-piece end cap includes a plate, a perimeter wall extending around a perimeter of the plate. The single-piece end cap further includes structural tabs that protrude out from the plate. The structural tabs are used to attach the single-piece end cap to an extrusion frame.

20 Claims, 8 Drawing Sheets

SINGLE-PIECE END CAP

CROSS REFERENCE TO RELATED APPLICATIONS

The present application claims priority under 35 U.S.C. Section 119(e) to U.S. Provisional Patent Application No. 62/367,451, filed Jul. 27, 2016 and titled "Single Piece End Cap," the entire content of which is incorporated herein by reference.

TECHNICAL FIELD

The present disclosure relates generally to lighting solutions, and more particularly to a single-piece end cap.

BACKGROUND

High-low-voltage (HLV) lighting fixtures may include an end plate that is attached to a mid-cap at one or both longitudinal ends of the lighting fixtures. The seam that exists between the end plate and the mid-cap is generally noticeable and can result in an unappealing aesthetic appearance. In some cases, many screws are used to secure the end plate to the mid-cap and to secure the mid-cap to one or more extrusion frames of a lighting fixture. The relatively large number of screws and other parts can make assembly/installation a time consuming and expensive process. Further, a multiunit HLV lighting fixture may require a joiner cap that is positioned between adjacent mid-caps for attachment of the individual lighting fixture units to each other to form the multiunit lighting fixture. Thus, a single unit end cap that can be coupled to extrusion frames of an HLV lighting fixture without use of a mid-cap and a relatively small number of fasteners may reduce assembly/installation time and cost while providing an improved aesthetic appearance. Further, single-piece end caps that can be coupled together without use of a joiner cap in the assembly/installation of multiunit HLV lighting fixtures may also reduce assembly/installation time and cost while providing improved an aesthetic appearance.

SUMMARY

The present disclosure relates generally to lighting solutions, and more particularly to a single-piece end cap. In an example embodiment, a single-piece end cap includes a plate, a perimeter wall extending around a perimeter of the plate. The single-piece end cap further includes structural tabs that protrude out from the plate. The structural tabs are used to attach the single-piece end cap to an extrusion frame.

In another example embodiment, a lighting fixture includes a first end cap, a second end cap, a first extrusion frame, and a second extrusion frame. The first end cap is attached to the first extrusion frame and to the second extrusion frame at a first end of the lighting fixture. The second cap is attached to the first extrusion frame and to the second extrusion frame at a second end of the lighting fixture. The first end cap and the second end cap each comprise a plate, structural tabs protruding out from the plate, where the structural tabs are inserted into respective channels of the first extrusion frame and the second extrusion frame.

In another example embodiment, a multi-unit lighting fixture includes a first lighting fixture and a second lighting fixture, where the first lighting fixture and the second lighting fixture each includes an end cap, a first extrusion frame, and a second extrusion frame. The first extrusion frame and the second extrusion frame are attached to the end cap, where the end cap of the first lighting fixture is attached to the end cap of the second lighting fixture.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
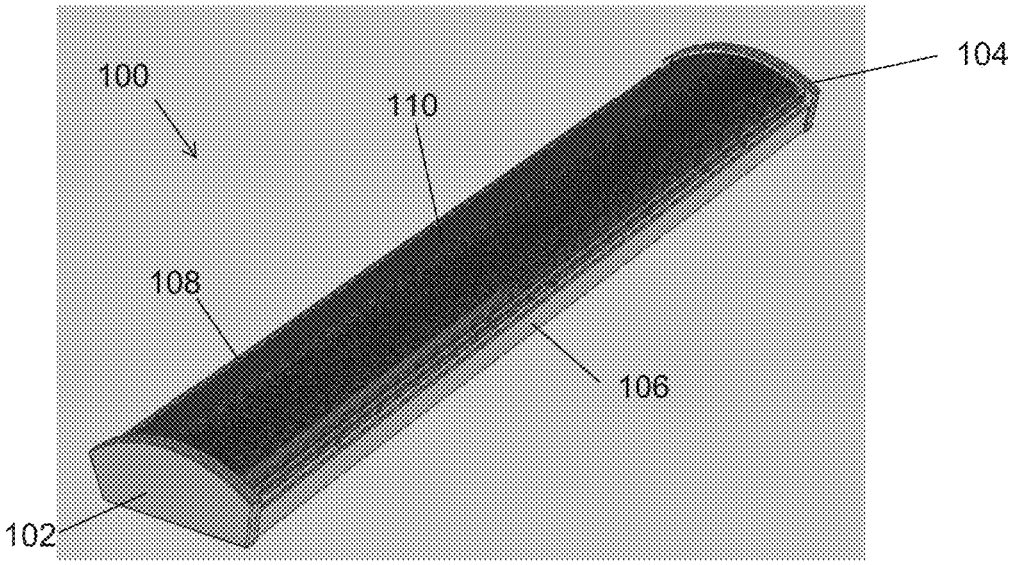
FIG. 1 illustrates a high-low-voltage (HLV) lighting fixture including single-piece end caps according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

FIG. 1 illustrates a high-low-voltage (HLV) lighting fixture 100 including single-piece end caps 102, 104 according to an example embodiment. In some example embodiments, the lighting fixture 100 includes the end caps 102, 104, extrusion frames 106, 108, and a lens 110. The end cap 102 is disposed at one end of the lighting fixture 100, and the end cap 104 is disposed at an opposite end of the lighting fixture 100. The end caps 102, 104 are attached to the extrusion frames 106, 108, at opposite ends of the lighting fixture 100.

In some example embodiments, each end cap 102, 104 is made as a one piece die cast part, which allows the lighting fixtures 100 to have a smooth painted surface. For example, the end caps 102, 104 may be made from aluminum. The extrusion frames 106, 108 may also be made from aluminum and may be made, for example, by extrusion. The lighting fixture 100 may be an eight inch or twelve inch wide lighting fixture.

In some example embodiments, the extrusion frames 106, 108 may be attached to a structure, such as a ceiling, where the lens 110 faces down toward the floor below the lighting fixture 100. In some example embodiments, the lens 110 may be attached to the extrusion frames 106, 108. Each extrusion frame 106, 108 may be designed to hold the lens 110 along the linear/longitudinal length of the lighting fixture 100. In some example embodiments, the lens 110 can be retained by a number of small screws, such as Allen head screws, on each side of lighting fixture 100. In some example embodiments, the lens 110 has clear, opal, and/or prismatic styles.

Because the end caps 102, 104 are attached to the extrusion frames 106, 108, the end caps 102, 104 eliminate the need for a mid-cap between the end cap 102 and the extrusion frames 106, 108, and between the end cap 104 and the extrusion frames 106, 108. By eliminating the need for mid-caps, additional screws (e.g., six 1.25" long screws) that may be needed for attaching mid-caps can also be avoided, thus reducing cost and assembly time as well as eliminating the need for an impact driver that may otherwise be needed.

In some example embodiments, the end caps 102, 104 and the extrusions 106, 108 may have different shapes than shown in FIG. 1 without departing from the scope of this disclosure. In some example embodiments, the lens 110 may have a different shape than shown without departing from the scope of this disclosure.

Figure 2:
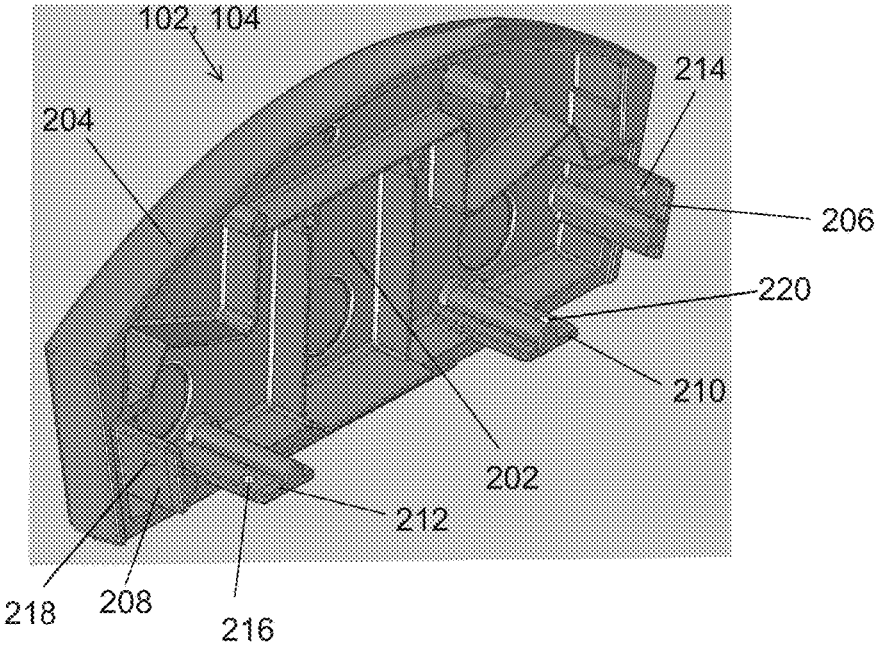
FIGS. 2-4 illustrate different views of the end caps of FIG. 1 according to an example embodiment.
Figure 3:
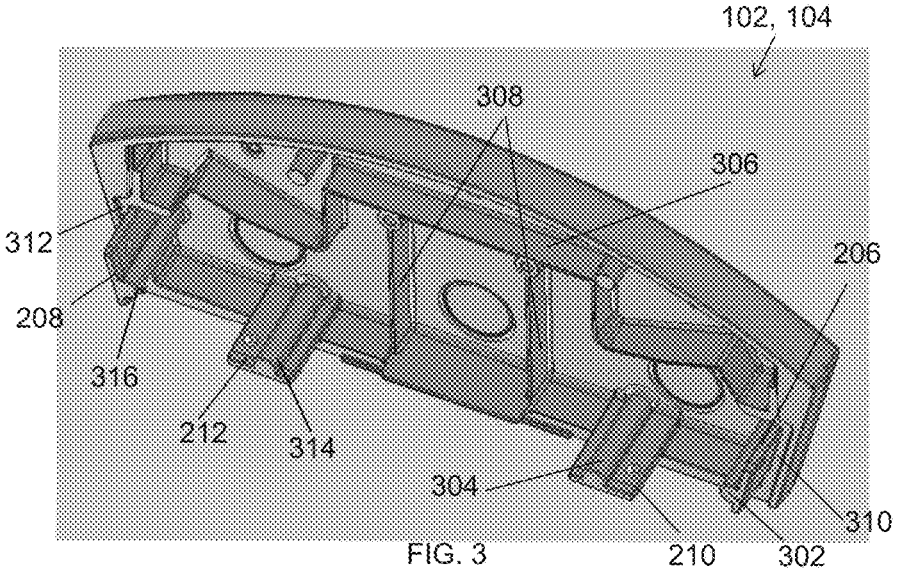
Figure 4:
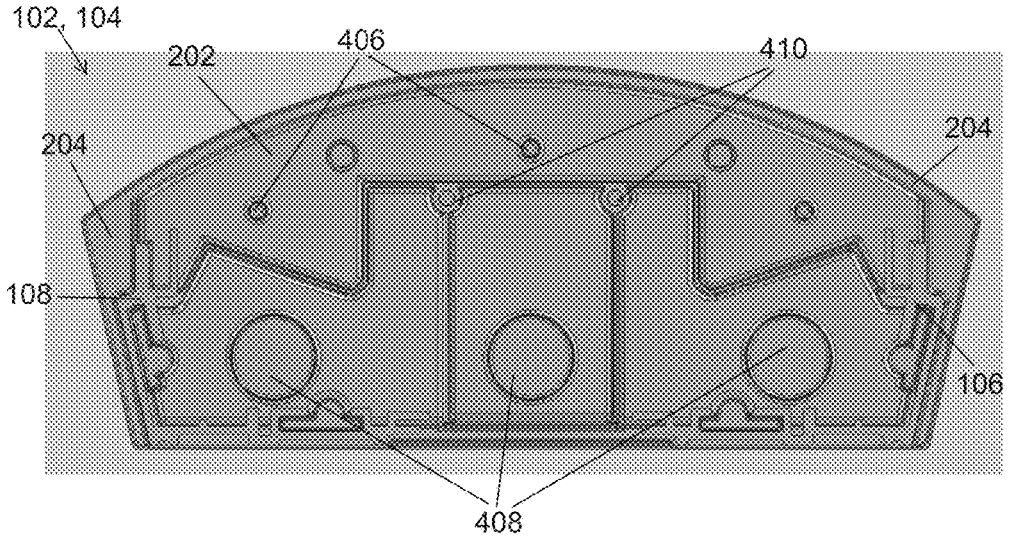

FIGS. 2-4 illustrate different views of the end caps 102, 104 of the lighting fixture 100 of FIG. 1 according to an example embodiment. Referring to FIGS. 1-4, each end cap 102, 104 may include a plate 202 and a perimeter wall 204 extending around a perimeter of the plate 202. Each end cap 102, 104 may also include structural tabs 206, 208, 210, 212 that protrude away from the plate 202. The structural tabs 206, 208, 210, 212 are used for attaching each end cap 102, 104 to the extrusion frames 106, 108. To illustrate, the structural tabs 206, 208, 210, 212 are designed to fit into respective slots of the extrusion frames 106, 108.

In some example embodiments, the structural tabs 206, 208, 210, 212 may include structural ribs that can provide a more stable attachment between the end caps 102, 104 and the extrusion frames 106, 108, for example, by restricting movement of extrusion frames 106, 108 relative to the end caps 102, 104. For example, the structural tab 206 may include a structural rib 302, the structural tab 208 may include a structural rib 316, the structural tab 210 may include a structural rib 304, and the structural tab 212 may include a structural rib 314. In some alternative embodiments, the structural ribs 302, 304, 314, 316 may have a different shape than shown without departing from the scope of this disclosure.

In some example embodiments, the structural tabs 206, 208, 210, 212 may each include a hole that may be used for attachment of the end caps 102, 104 to the extrusion frames 106, 108. For example, the structural tab 206 may include a hole 214, the structural tab 208 may include a hole 218, the structural tab 210 may include a hole 220, and the structural tab 212 may include a hole 216. Fasteners, such as screws, may be inserted in the holes 214, 216, 218, 220 and in corresponding holes in the extrusion frames 106, 108 to attach the end caps 102, 104 to the extrusion frames 106, 108. In some alternative embodiments, the holes 214, 216, 218, 220 may have different shapes or may be positioned at different locations than shown without departing from the scope of this disclosure.

In some example embodiments, the end caps 102, 104 may include recessed areas 310, 312 as shown more clearly shown in FIG. 3. The recessed areas 310, 312 are designed to receive the extrusion frames 106, 108 therein. In some example embodiments, the end caps 102, 104 may also include a gasket retainer structure 306 to receive a gasket and retain the gasket attached to the end caps 102, 104. The gasket retainer structure 306 of each end cap 102, 104 is designed to retain, for example, a precut, closed cell, neoprene gasket that allows the lens 110 to compress in one direction during installation. To illustrate, when an end of the lens 110 is moved to the inside of the end cap 102 during installation, the compression of the gasket of the end cap 102 may push the lens 110 back toward the gasket of the end cap 104, sealing both ends of the lighting fixture 110.

In some example embodiments, each end cap 102, 104 includes walls 308. For example, the walls 308 may provide structural support to the gasket retainer structure 306. In some alternative embodiments, the end caps 102, 104 may each include more or fewer of the walls 308 than shown without departing from the scope of this disclosure.

Figure 12:
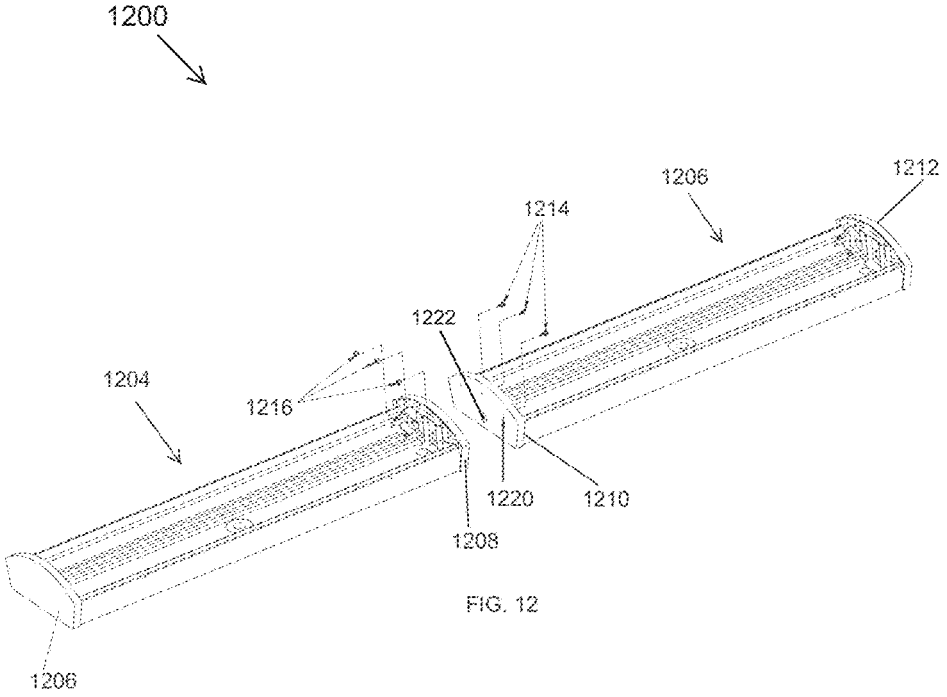
FIG. 12 illustrates a multi-unit HLV lighting fixture according to an example embodiment.

In some example embodiments, the plate 202 of each end cap 102, 104 may include knockout sections 406 that can be removed (e.g., knocked or punched out). For example, assembling a multi-unit lighting fixture, such as shown in FIG. 12, may require attaching the end caps of adjacent units to each other. For example, a multi-unit lighting fixture may include two of the lighting fixtures 100 such that the end cap 102 of the first lighting fixture 100 is secured to the end cap 104 of the second lighting fixture 100. To illustrate, after the knockout sections 406 are removed, end caps of adjacent units of a multi-unit lighting fixture may be secured to each other using fasteners that extend through the holes formed by knocking out the knockout sections 406. For example, machine screws and nuts may be inserted through respective knocked out knockout sections 406 of adjacent end caps to secure the end caps.

In some example embodiments, the plate 202 of end caps 102, 104 may also include larger knockout sections 408 that can be removed (e.g., knocked or punched out) to provide one or more passages for wires, etc. In some example embodiments, the end caps 102, 104 may include more or fewer knockout sections than shown without departing from the scope of this disclosure. In some alternative embodiments, one or more of the knockout sections 406, 410 may have shapes other than shown without departing from the scope of this disclosure. In some example embodiments, the end caps 102, 104 may also include holes 410 for attaching a reflector or another similar structure to the end caps 102, 104, for example, using fasteners.

In some example embodiment, one or more of the knockout sections 406 and other knock out structures of the end caps 102, 104 may be removed, for example, at the factory, prior to shipment of the end caps 102, 104 to a customer. Alternatively, the knockout sections 406 and other knock out structures of the end caps 102, 104 may be removed by the customer or by an installation contractor after receiving end caps 102, 104, for example, to attach multiple lighting fixtures 100 end to end to install as in-row or multi-unit lighting fixtures.

As illustrated in FIG. 4, the extrusion frames 106, 108 may be positioned in the respective recessed areas 310, 112 of each end cap 102, 104. For example, the structural tabs 206, 208, 210, 212 are inserted in respective slots of the extrusion frames 106, 108. The slots of the extrusion frames 106, 108 are more clearly shown in FIG. 6.

By enabling attachment of the extrusion frames 106, 108 to the end caps 102, 104, the end caps 102, 104 eliminate the need for a mid-cap between the end caps 102, 104 and the extrusion frames 106, 108. By eliminating the need for mid-caps, additional screws that may be needed for attaching mid-caps can also be avoided, thus reducing cost and assembly time as well as eliminating the need for an impact driver that may otherwise be needed.

In some alternative embodiments, the end caps 102, 104 may have a different shape than shown without departing from the scope of this disclosure. In some alternative embodiments, the end caps 102, 104 may include fewer or more structural tabs than shown and/or may include other structures without departing from the scope of this disclosure. In some alternative embodiments, the structural tabs 206, 208, 210, 212 may be at different locations and may have a different shape than shown without departing from the scope of this disclosure.

Figure 5:
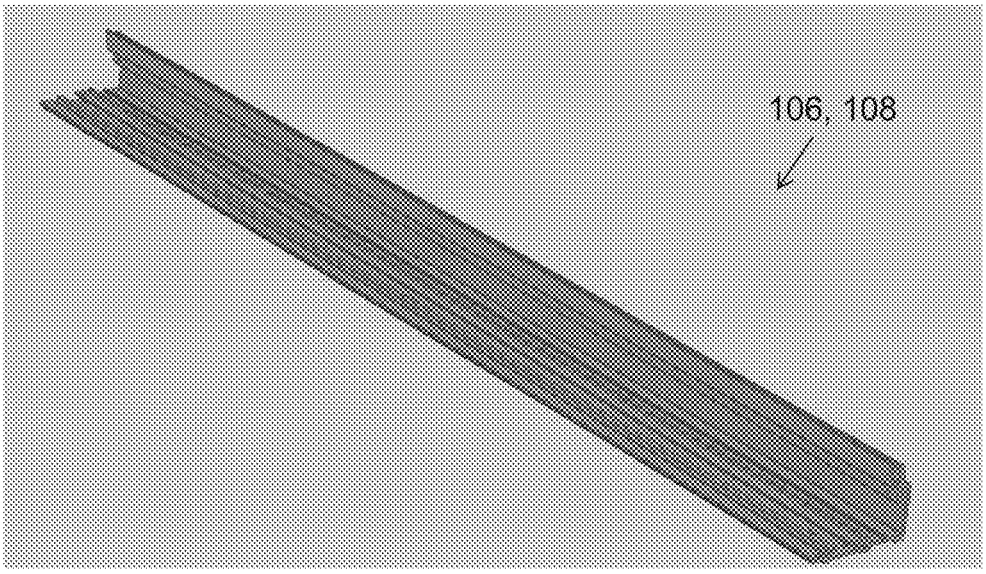
FIGS. 5-7 illustrate different views of extrusions of the lighting fixture of FIG. 1 according to an example embodiment.
Figure 6:
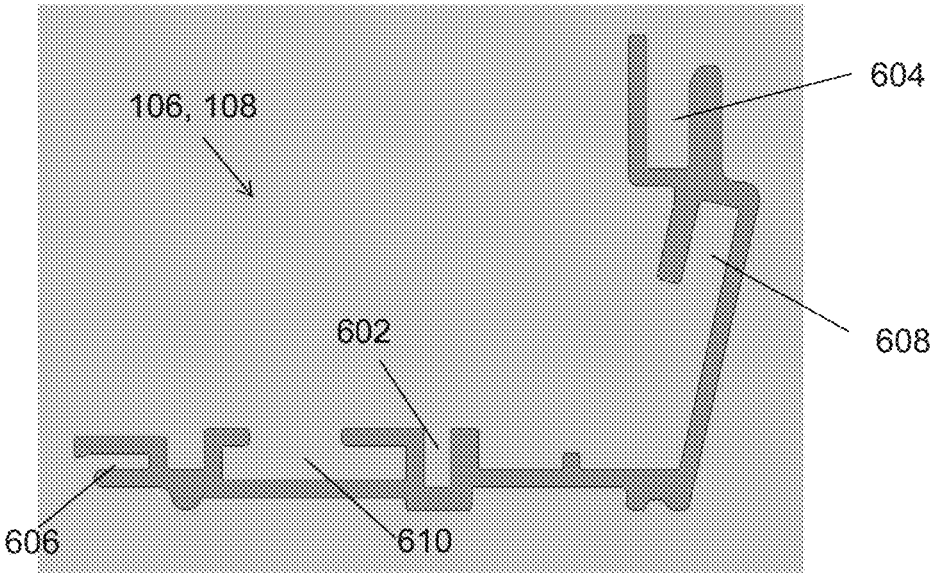
Figure 7:
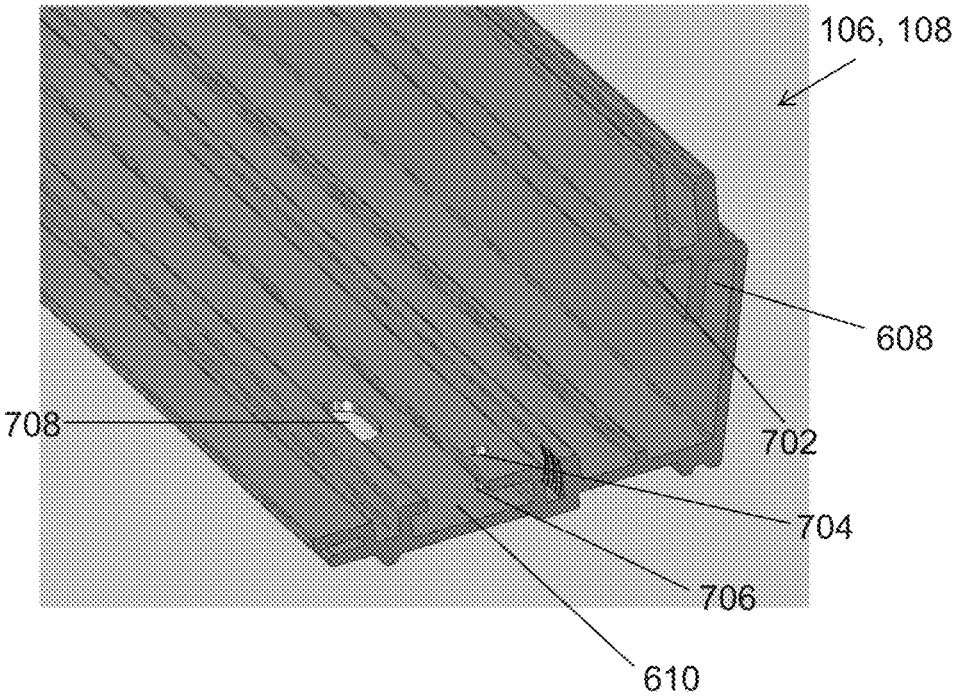

FIGS. 5-7 illustrate different views of the extrusion frame 106, 108 of the lighting fixture 100 of FIG. 1 according to an example embodiment. In some example embodiments, the extrusion frames 106, 108 may have a symmetrical design such that either extrusion frame may be used in place of the other. That is, an extrusion frame may have a design that enables the extrusion frame to be used on either side of the lighting fixture 4100.

In some example embodiments, each extrusion frame 106, 108 may include a channel 602, such as a threaded channel, that allows a threaded screw to be inserted therein to secure a ballast, driver, and/or other components to the extrusion frame 106, 108. Each extrusion frame 106, 108 may also include a channel 604 to receive a lens such as the lens 110 shown in FIG. 1. Each extrusion frame 106, 108 may also include a side channel 606 for receiving a linear back plate therein such that the back plate extends between the extrusion frames 106, 108. Each extrusion frame 106, 108 may also include channels 608, 610 that are designed to receive the structural tabs 206, 208, 210, 212 of the end caps 102, 104. In some example embodiments, the extrusion frame 106, 108 can be one, two, three, four or eight foot long and can be used in lighting fixtures that are eight and twelve inches wide. In some example embodiments, the extrusion frames 106, 108, and the back plate form define a housing assembly of the lighting fixture 100.

Referring to FIGS. 1-7, the end caps 102, 104 can be used with the extrusion frames 106, 108 that are designed to be symmetrical to be used on both sides of the housing assembly in some example embodiments, each extrusion frame 106, 108 may include attachment holes 702, 704, 706 that are used in the attachment of the extrusion frames 106, 108 to the end caps 102, 104 of FIG. 1. To illustrate, the structural tab 206 of the end cap 102 may be inserted into the channel 608 of the extrusion frame 106 at an end of the extrusion frame 106, and the structural tab 210 of the end cap 102 may be inserted into the channel 610 of the extrusion frame 106 at the same end of the extrusion frame 106. The structural tab 208 of the end cap 102 may be inserted into the channel 608 of the extrusion frame 108 at the opposite end of the extrusion frame 108, and the structural tab 212 may be inserted into channel 610 of the extrusion frame 108 at the same opposite end of the extrusion frame 108. The structural tab 206 of the end cap 104 may be inserted into the channel 608 of the extrusion frame 108 at an end of the extrusion frame 108, and the structural tab 210 of the end cap 104 may be inserted into the channel 610 of the extrusion frame 108 at the same end of the extrusion frame 108. The structural tab 208 of the end cap 104 may be inserted into the channel 608 of the extrusion frame 106 at the opposite end of the extrusion frame 106, and the structural tab 212 may be inserted into channel 610 of the extrusion frame 106 at the same opposite end of the extrusion frame 106.

In some example embodiments, screws inserted in the holes 702, 704, 706 may be used to attach the structural tabs 206, 208, 210, 212 of each end cap 102, 104 to the extrusion frames 106, 108. To illustrate, after the structural tabs 206, 208, 210, 212 of each end cap 102, 104 are each inserted in the respective channel of the extrusion frame 106, 108, the structural tabs 206, 208, 210, 212 are locked into place by inserting screws into respective holes.

In some example embodiments, a total of only four screws may be used to securely attach each end cap 102, 104 to the extrusion frames 106, 108. For example, four #8×¼" long hex head, sheet metal screws may be used to securely attach each end cap 102, 104 to the extrusion frames 106, 108. To illustrate, a screw inserted in the hole 214 of the structural tab 206 and the hole 702 of the extrusion frame 106 may be used to attach the structural tab 206 to the extrusion frame 106. A screw inserted in the hole 218 of the structural tab 208 and the hole 702 of the extrusion frame 108 may be used to attach the structural tab 208 to the extrusion frame 108. A screw inserted in the hole 210 of the structural tab 210 and the holes 704, 706 of the extrusion frame 106 may be used to attach the structural tab 210 to the extrusion frame 106. A screw inserted in the hole 216 of the structural tab 212 and the holes 704, 706 of the extrusion frame 108 may be used to attach the structural tab 212 to the extrusion frame 108. In some example embodiments, the screws inserted in the attachment holes 702, 704 may not extend through the respective hole 706.

In some example embodiments, the extrusion frames 106, 108 may also include a mounting hole 708 for attaching the each extrusion frame 106, 108, thus, the lighting fixture 100 to a structure, such as a ceiling, with the lens 110 facing down toward the floor.

In some alternative embodiments, one or more of the structural tabs of the end caps 102, 108 may be attached to the extrusion frames 106, 108 using means other than screws without departing from the scope of this disclosure. In some example embodiments, one or more of the channels 602, 604, 606, 608, 610 may have a different shape than shown without departing from the scope of this disclosure.

Figure 8:
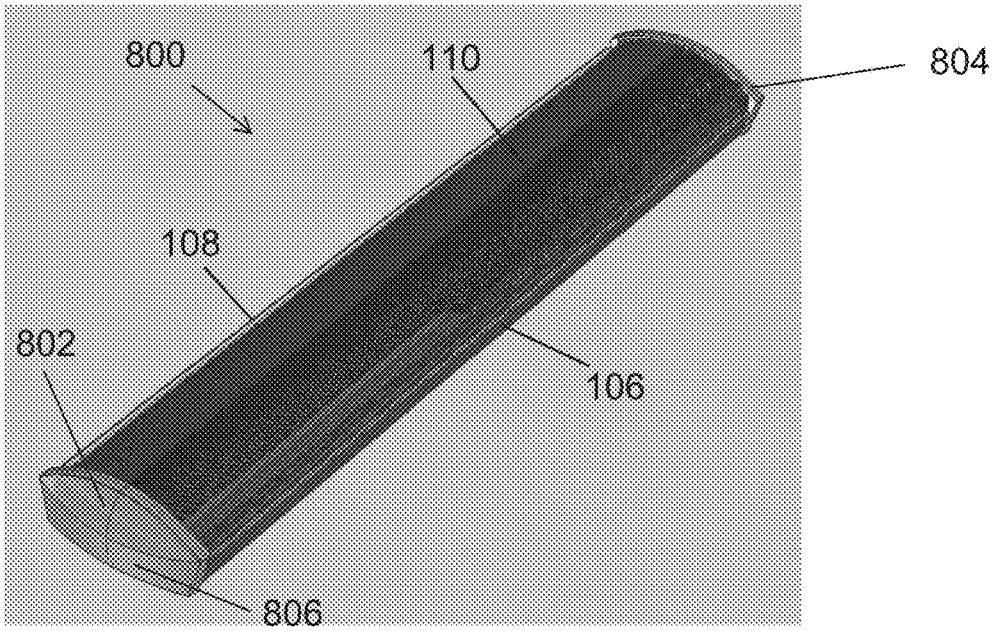
FIG. 8 illustrates a high-low-voltage (HLV) lighting fixture including a decorative single-piece end cap according to another example embodiment.

FIG. 8 illustrates a high-low-voltage (HLV) lighting fixture 800 including a single-piece end cap 802 according to another example embodiment. In some example embodiments, the lighting fixture 800 is similar to the lighting fixture 100 FIG. 1. For example, the lighting fixture 800 includes extrusion frames 106, 108, and the lens 110. The lighting fixture 800 may include an end cap 802 and an end cap 804 that are attached to the end frames 106, 108 in a similar manner as described above with respect to the end caps 102, 104. In contrast to the end caps 102, 104, the end caps 802, 804 may have a decorative shape or surface 806, where the end caps 102, 104 have may have a substantially flat surface. In some alternative embodiments, one of the end caps 802, 804 may be an instance of the end cap 102 or 104. In some example embodiments, the lighting fixture 800 may be an eight inch or twelve inch wide lighting fixture.

Figure 9:
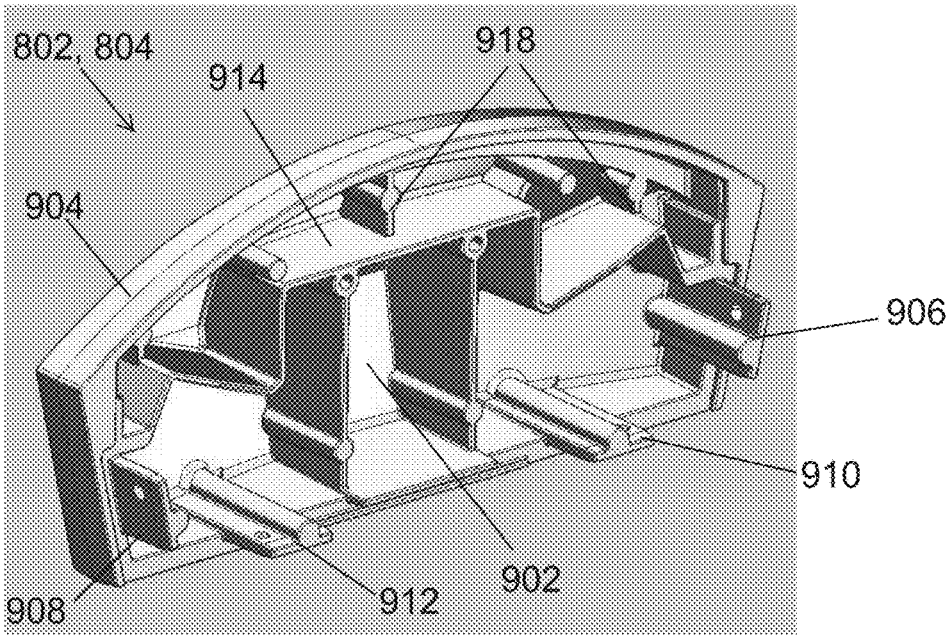
FIGS. 9 and 10 illustrate different views of the end cap of FIG. 8 according to an example embodiment.
Figure 10:
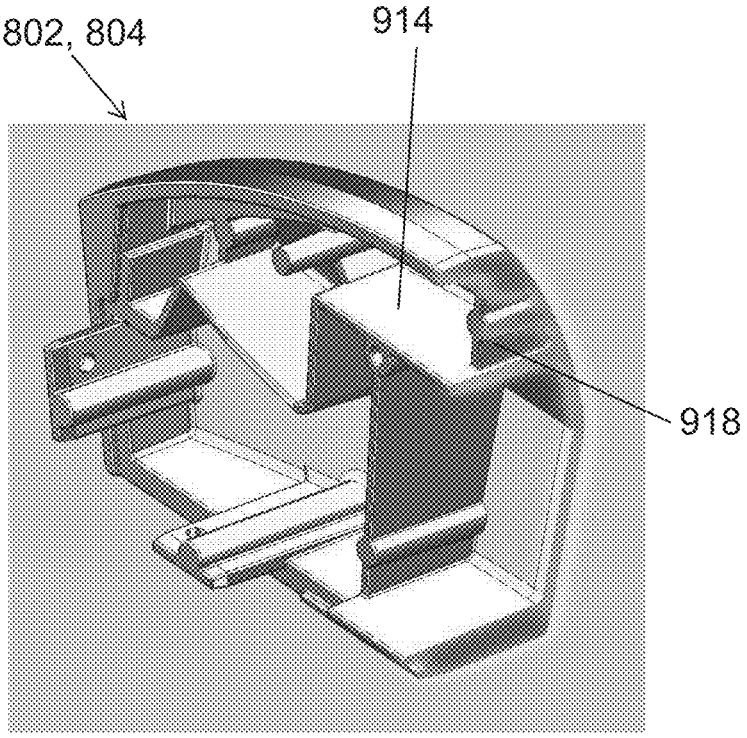

FIG. 9 illustrates a perspective view of the end cap 802 of FIG. 8 according to an example embodiment. FIG. 10 illustrates a cross-sectional view of the end cap 802 of FIG. 8 according to an example embodiment. Referring to FIGS.

9 and 10, in some example embodiments, the end caps 802, 804 may include structural tabs 906, 908, 910, 912, which are similar to the structural tabs 206, 208, 210, 212 of the end caps 102, 104. The end caps 802, 804 may include a plate 902 and a perimeter wall 904 that extends around the perimeter of the plate 902. The end caps 802, 804 may also include a gasket retainer structure 914. Structures 918 that may extend up from and/or down to a gasket retainer structure 914 can prevent a gasket that gets attached to the gasket retainer structure 914 from sliding too far back toward the plate of the 902.

In some alternative embodiments, the end caps 802, 804 may have a different shape than shown without departing from the scope of this disclosure. In some alternative embodiments, the end caps 802, 804 may include fewer or more structural tabs than shown and/or may include other structures without departing from the scope of this disclosure. In some alternative embodiments, the structural tabs 906, 908, 910, 912 may be at different locations and may have a different shape than shown without departing from the scope of this disclosure.

Figure 11:
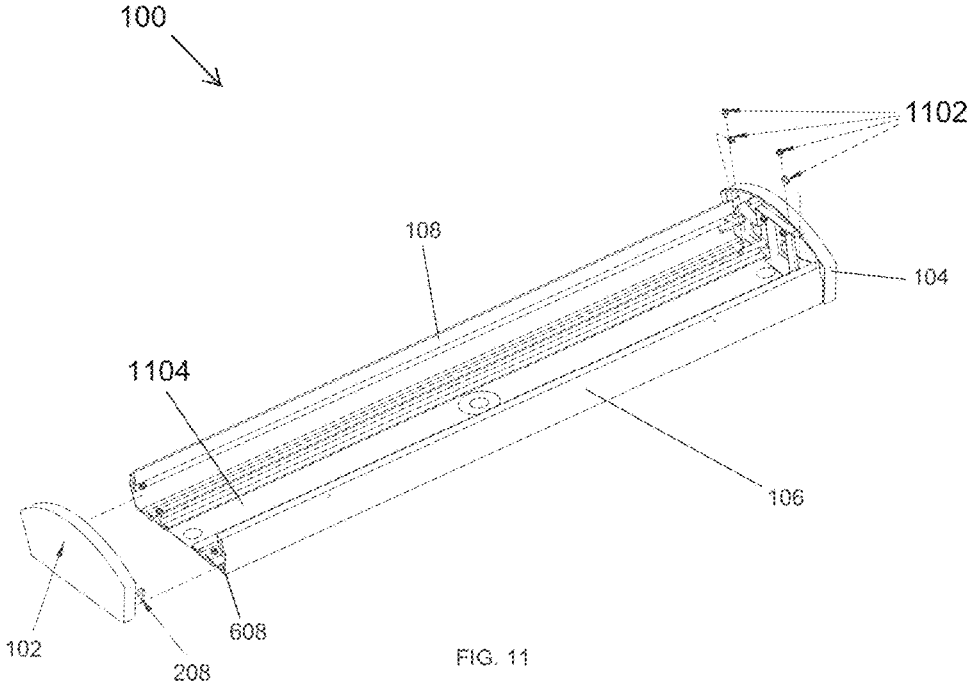
FIG. 11 illustrates a partially exploded view of an HLV lighting fixture according to another example embodiment.

FIG. 11 illustrates a partially exploded view of an HLV lighting fixture 100 according to an example embodiment. The lighting fixture 1100 includes the end caps 102, 104, and the extrusion frames 106, 108. The extrusion frames 106, 108 may be attached to the end cap 104 using screw 1102 in the same manner as described above. The extrusion frames 106, 108 may be attached to the end cap 102 in a similar manner as described above. For example, the structural tab 208 may be inserted in the channel 608 and may be secured by a fastener as described above. In some example embodiments, the lighting fixture 100 also includes a back plate 1104 that is inserted in the side channel 606 of each of the extrusion frames 106, 108.

Ballasts and/or drivers can be fastened to the extrusion frames 106, 108 with two vertically driven fasteners because of the design of the extrusion frames 106, 108 that allows creating a threading channel. For example, the channel 602 in each extrusion frame 106, 108 can accept the #8-1×4 washer head, ballast screw that can be installed at any location in the linear length of the extrusion frame 106, 108.

FIG. 12 illustrates a multi-unit HLV lighting fixture 1200 according to an example embodiment. In some example embodiments, the lighting fixture 1200 may be assembled from a lighting fixture 1204 and a lighting fixture 1206 that may be joined together to form the lighting fixture 1200. For example, each of the lighting fixtures 1104, 1106 may correspond to the lighting fixture 100 shown in FIGS. 1 and 11.

In some example embodiments, the lighting fixture 1204 includes end caps 1206, 1208, and the lighting fixture 1206 includes end caps 1210, 1212. For example, the end caps 1206, 1208 may respectively correspond to the end caps 102, 104 of the lighting fixture 100, and the end caps 1210, 1212 may respectively correspond to the end caps 102, 104 of the lighting fixture 100. By knocking out the knockout sections of the end caps 1208, 1210, holes, such as the hole 1220 in the end cap 1210, are formed in the plates of the end caps 1208, 1210 that enable attaching the end caps 1208, 1210 to each other using screws. For example, screws 1214 and nuts 1216 may be used to securely attach the end caps 1208, 1210 to each other though the holes formed by removing respective knockout sections in each end cap 1208, 1210. In some example embodiments, holes, such as the hole 1222 in the plate of the end cap 1210, enable routing one or more electrical wires between the lighting fixtures 1204, 1206. In some example embodiments, one or both of the end caps 1206, 1212 may be replaced by a decorative end cap, such as the end caps 802, 804 shown in FIGS. 8-10.

By coupling the adjacent end caps without the use of a mid-cap, installation/assembly of the multi-unit HLV lighting fixture can be significantly improved. The end caps 1206, 1208, 1210, 1212 and the extrusion frames eliminate material, and dramatically reduce assembly time. Further, the aesthetic appearance of the multi-unit HLV lighting fixture is improved by avoiding the extra seams that are formed between a mid-cap and joiner caps. By using the one-piece end caps 102, 104, 802, the visible seam that exists between the mid-cap and the end plate of some existing lighting fixtures can be eliminated. The end caps 1206, 1208, 1210, 1212 and the extrusion frames also require far fewer fasteners, such as T-studs and pal nuts and screws, compared to some existing lighting fixtures (e.g., from 32 down to 8 screws).

In some example embodiments, ballasts and/or drivers can be fastened to the extrusion frames of one or both lighting fixtures 1204, 1206 with two vertically driven fasteners because of the design of the extrusion frames that allows creating a threading channel. The knockout sections of the end caps 1208, 1210 may be removed, for example, at the factory, prior to shipment of the end caps to a customer. Alternatively, the knockout sections may be removed by the customer or by an installation contractor.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A single-piece end cap, comprising:

a plate;

a perimeter wall extending around a perimeter of the plate; and structural tabs that protrude out from the plate, wherein the structural tabs are used to attach the single-piece end cap to an extrusion frame and wherein the structural tabs include one or more holes that are used to securely attach the single-piece end cap to the extrusion frame.

2. The single-piece end cap of claim 1, further comprising a gasket retainer structure to retain a gasket attached to the single-piece end cap.

3. The single-piece end cap of claim 1, further comprising a recessed area to receive the extrusion frame.

4. The single-piece end cap of claim 3, wherein the recessed area is formed between one structural tab of the structural tabs and the perimeter wall.

5. The single-piece end cap of claim 3, further comprising a second recessed area to receive a second extrusion frame.

6. The single-piece end cap of claim 1, wherein one or more of the structural tabs include one or more structural ribs that provide a stable attachment between the single-piece end cap and the extrusion frame.

7. A lighting fixture, comprising:

a first end cap;

a second end cap;

a first extrusion frame; and a second extrusion frame, wherein the first end cap is attached to the first extrusion frame and to the second extrusion frame at a first end of the lighting fixture, wherein the second end cap is attached to the first extrusion frame and to the second extrusion frame at a second end of the lighting fixture, wherein the first end cap and the second end cap each comprise:

a plate;

structural tabs protruding out from the plate, wherein the structural tabs are inserted into respective channels of the first extrusion frame and the second extrusion frame and wherein the first extrusion frame and the second extrusion frame are securely attached to the first end cap and the second end cap by fasteners that extend through first holes in the structural tabs of the first end cap and the second end cap and respective second holes in the first extrusion frame and the second extrusion frame.

8. The lighting fixture of claim 7, further comprising a lens extending between the first end cap and the second end cap and attached to the first extrusion frame and the second extrusion frame.

9. The lighting fixture of claim 7, wherein the first end cap and the second end cap each comprise recessed areas to receive the first extrusion frame and the second extrusion frame.

10. The lighting fixture of claim 7, wherein one or more of the structural tabs of the first end cap and the second end cap include a respective structural rib that provides a stable attachment between each of the first end cap and the second end cap and each of the first extrusion frame and the second extrusion frame.

11. The lighting fixture of claim 7, wherein the first end cap comprises a first gasket retainer structure to retain a first gasket attached to the first end cap and the second end cap comprises a second gasket retainer structure to retain a second gasket attached to the second end cap.

12. The lighting fixture of claim 7, wherein the first extrusion frame and the second extrusion frame each includes a threading channel for vertical attachment of a driver or a ballast using screws.

13. The lighting fixture of claim 7, wherein the first end cap and the second end cap each comprise one or more knockout sections formed in the plate, wherein the one or more knockout sections are removable to form one or more holes in the plate.

14. A multi-unit lighting fixture, comprising:

a first lighting fixture; and a second lighting fixture, wherein the first lighting fixture and the second lighting fixture each includes:

an end cap;

a first extrusion frame; and a second extrusion frame, wherein the first extrusion frame and the second extrusion frame are attached to the end cap, wherein the end cap of the first lighting fixture is attached to the end cap of the second lighting fixture, and wherein the end cap of the first lighting fixture is attached to the end cap of the second lighting fixture by fasteners that extend through respective holes in a plate of the end cap of the first lighting fixture and in a plate of the end cap of the second lighting fixture.

15. The lighting fixture of claim 14, wherein the end cap of the first lighting fixture and the end cap of the second lighting fixture each comprise structural tabs, wherein the structural tabs are inserted into respective channels of the first extrusion frame and the second extrusion frame.

16. The lighting fixture of claim 15, wherein the first extrusion frame and the second extrusion frame of the first lighting fixture are securely attached to the end cap of the first lighting fixture by fasteners that extend through holes in the structural tabs of the end cap of the first lighting fixture and respective holes in the first extrusion frame and the second extrusion frame of the first lighting fixture.

17. The lighting fixture of claim 14, wherein the end cap of the first lighting fixture comprises one or more first knockout sections formed in the plate of the end cap of the first lighting fixture, and wherein the end cap of the second lighting fixture comprises one or more second knockout sections formed in the plate of the end cap of the second lighting fixture.

18. A single-piece end cap, comprising:

a plate;

a perimeter wall extending around a perimeter of the plate;

structural tabs that protrude out from the plate, wherein the structural tabs are used to attach the single-piece end cap to an extrusion frame; and one or more knockout sections formed in the plate, wherein the one or more knockout sections are removable to form one or more holes in the plate.

19. The single-piece end cap of claim 18, further comprising a gasket retainer structure to retain a gasket attached to the single-piece end cap.

20. The single-piece end cap of claim 18, further comprising a recessed area to receive the extrusion frame, wherein the recessed area is formed between one structural tab of the structural tabs and the perimeter wall.

* * * * *